United States Patent [19]

Lorey et al.

[11] Patent Number: 4,993,833

[45] Date of Patent: Feb. 19, 1991

[54] WEAPON AIMING DEVICE

[75] Inventors: Otto Lorey, Reichertshausen; Günter Mauer, Poppenlauer, both of Fed. Rep. of Germany

[73] Assignees: Kontron Elektronik GmbH; Friedrich Wilh. Heym GmbH & Co., KG, both of Fed. Rep. of Germany; a part interest

[21] Appl. No.: 252,325

[22] Filed: Oct. 3, 1988

[30] Foreign Application Priority Data

Oct. 9, 1987 [CH] Switzerland ..... 3961/87

[51] Int. Cl.[5] ..... G02B 27/34; G02B 27/36

[52] U.S. Cl. ..... 356/252

[58] Field of Search ..... 356/247, 252, 253, 254, 356/255

[56] References Cited

U.S. PATENT DOCUMENTS

| | | | |
|---|---|---|---|
| 3,951,553 | 4/1976 | Oberheuser | 356/252 X |
| 4,213,700 | 7/1980 | LeBlanc | 356/252 |
| 4,317,304 | 3/1982 | Bass | 33/247 X |
| 4,483,598 | 11/1984 | Leightner et al. | 350/558 |
| 4,497,548 | 2/1985 | Burris | 350/560 |
| 4,695,161 | 9/1987 | Reed | 356/255 X |
| 4,794,430 | 12/1988 | Whittaker et al. | 356/252 |

FOREIGN PATENT DOCUMENTS

| | | |
|---|---|---|
| 3085 | 12/1978 | European Pat. Off. . |
| 99204 | 1/1984 | European Pat. Off. . |
| 234180 | 2/1987 | European Pat. Off. . |
| 2948994 | 6/1980 | Fed. Rep. of Germany . |
| 3011316 | 10/1980 | Fed. Rep. of Germany . |
| 3208814 | 9/1983 | Fed. Rep. of Germany . |
| 3501321 | 8/1985 | Fed. Rep. of Germany . |
| 2443696 | 7/1980 | France . |

*Primary Examiner*—Vincent P. McGraw

*Attorney, Agent, or Firm*—Evenson, Wands, Edwards, Lenahan & McKeown

[57] ABSTRACT

The invention relates to an aiming device for weapons whose targets are disposed at changing distances and whose fired projectiles follow a curved trajectory. The aiming device calculates the distance from the weapon to the target. The calculated distance is used as a basis for correcting the point of aim with allowance for the ballistical trajectory, the latter being dependent upon the particular weapon and particular ammunition used. To correct the point of aim, a storage medium storing the ballistic trajectory correlates the range-finding data with the ballistic trajectory data. The resulting signal actuates a row of diodes which are reflected into the beam path of the optical system. Depending upon the range and the trajectory, a particular diode of the row lights up and is brought into registration with the target.

14 Claims, 3 Drawing Sheets

WEAPON AIMING DEVICE

FIELD OF THE INVENTION

The invention relates to an aiming device for weapons whose targets are disposed at changing distances and whose fired projectiles follow a curved trajectory.

DESCRIPTION

There are various conventional aiming aids for the marksman. Disregarding optical enlargement, there are open sights. Peep sights or the like. Optical enlargement can be provided by aiming telescopes. When shooting over open sights the marksman must estimate the distance or range and choose his point of aim in accordance with the anticipated ballistic trajectory. The use of an aiming telescope provides a slight advantage since the marksman estimates the range with reference to the size of the imaged target and chooses his point of aim in accordance with the anticipated ballistic trajectory.

Range calculation is in both cases an estimate and is bound to be fairly inaccurate. Also, the marksman needs to know the ballistic trajectory, which he does not always know or which he does not know accurately enough. The marksman must in any case estimate the range before firing and convert this value into a corresponding correction of the point of aim and the point of impact, an operation which can be performed only with variable accuracy. This approach is bound to lead to inaccurate shots. The use of a sliding back sight or a back sight with range marks gives the marksman little help. Also, there are aiming telescopes having an adjusting ring enabling the back sight to be adjusted vertically in accordance with the range set. The range still is estimated inaccurately in such cases. Also, before firing, the sliding back sight must be adjusted to the range or the adjusting ring must be adjusted correspondingly, so that time becomes a problem when a quick shot is required.

SUMMARY OF THE INVENTION

The invention provides an aiming device for a weapon which automatically corrects the point of aim in accordance with range and ballistic trajectory and therefore brings the point of aim into registration with the point of impact at every range.

According to the invention, a range finder means similar to an aiming telescope is disposed in the aiming device. The range finder also can be received in the weapon. The range finder transmits a pulse such as a laser beam or infrared beam or sound waves or microwaves or the like. The pulse is reflected by a target and detected by the receiver in the aiming device or weapon. The range is therefore determined by the difference between the transit times in accordance with known techniques. The known ballistic trajectory data, which are determined by the particular weapon and particular ammunition used, are previously programmed in a storage means such as a semiconductor store.

The range-finding data are correlated with the ballistic trajectory data to produce a signal. The resulting signal triggers a vertical row of indicators such as diodes or liquid crystal cells which is reflected into the optical system of the aiming device on an image plane. Depending upon the range and the trajectory, a particular indicator of the row lights up. The illuminated indicator is brought into registration with the target to give the required congruency of point aim with point of impact.

The invention leads to the following advantages over known aiming aids:

The marksman no longer needs to assess range by his experiences;

The marksman no longer needs to convert the range-dependent ballistic trajectory into a point of aim differing from the point of impact;

The marksman does not need to adjust ranges, for example, by moving an adjustable back sight or the like, before firing;

The marksman can fire much faster and more accurately;

The marksman hits exactly where he has aimed; and

Simply by changing the storage medium the aiming device can be used for a very wide variety of weapons and ammunition.

According to another feature, the range calculated by the range finder is reflected into the aiming device in the form of a number or in the form of symbols. The aiming device can therefore also be used, conveniently, as a range finder. Yet another important advantage is that because of the accurate indication of range the marksman receives information about the kinetic energy striking the target, such energy being of course dependent upon the range. As a practical example, a hunter knows that the ammunition he uses can kill game only up to a particular range and that a shot fired over a greater range has too little kinetic energy to be lethal. The deflected-in and, therefore, visible range of the target is a useful aid in this connection.

BRIEF DESCRIPTION OF THE DRAWINGS

The invention will be described in greater detail with reference to the drawings wherein.

DETAILED DESCRIPTION OF THE PREFERRED EMBODIMENTS

Figure 1:
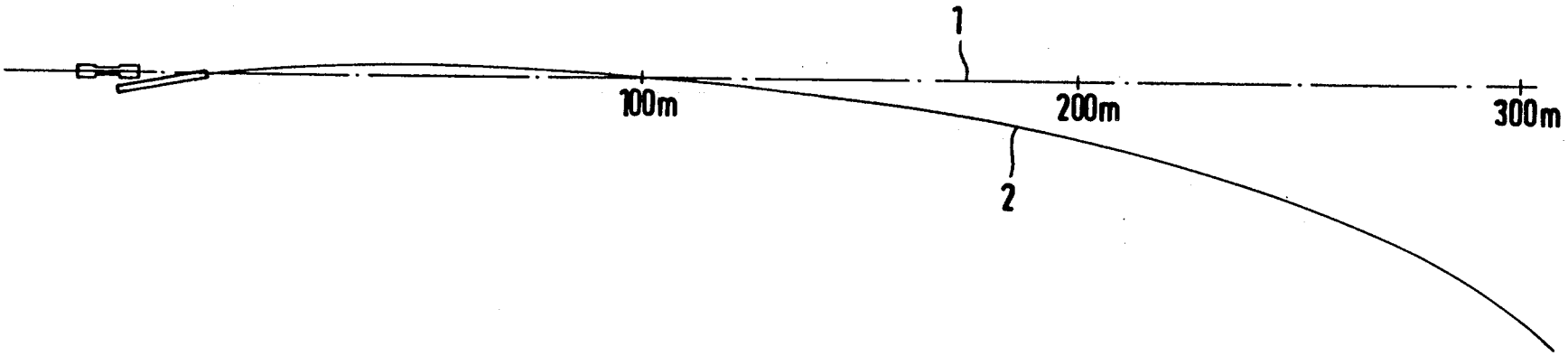
FIGS. 1 and 2 are diagrams of the trajectory of a weapon using conventional aiming devices.
Figure 2:
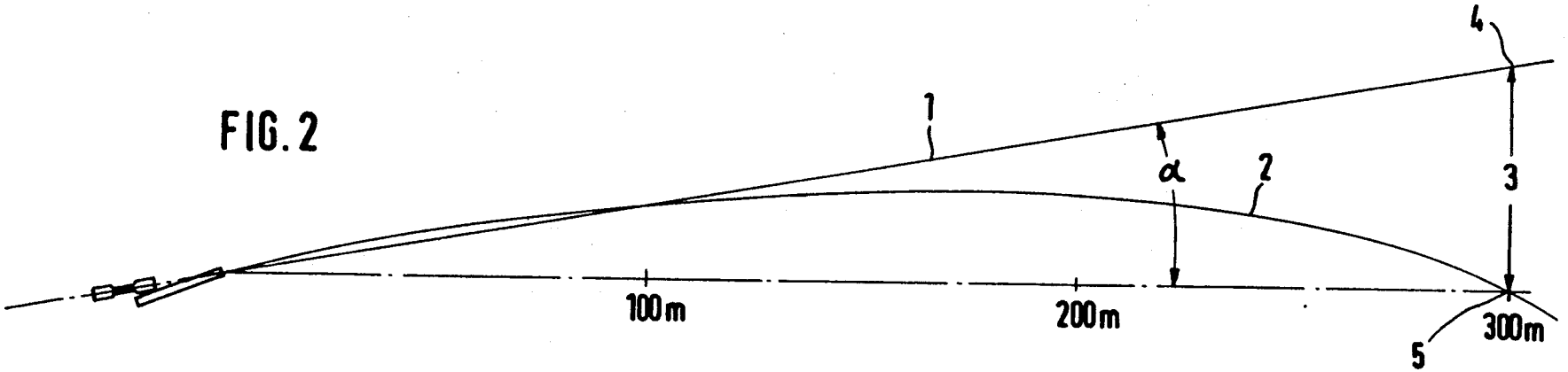

FIGS. 1 and 2 illustrate shooting with conventional aiming aids. In the case of FIG. 1 the weapon has been tested at 100 m. That is, at a 100 m range the aiming or sighting line 1 (beam path) and the ballistic trajectory 2 of the projectile cross one another. At ranges shorter than 100 m the point of impact on the ballistic trajectory is higher than the point of aim whereas at a range greater than 100 m the point of impact is lower than the point of aim. FIG. 2 illustrates shooting with the same weapon at 300 m range. To hit the target accurately at 300 m, the marksman must set the point of aim 4 higher than the point of impact 5 by a distance 3. This leads to a correction angle $\alpha$ which is of course inaccurate since the distance 3 must be estimated on the target plane.

Figure 3:
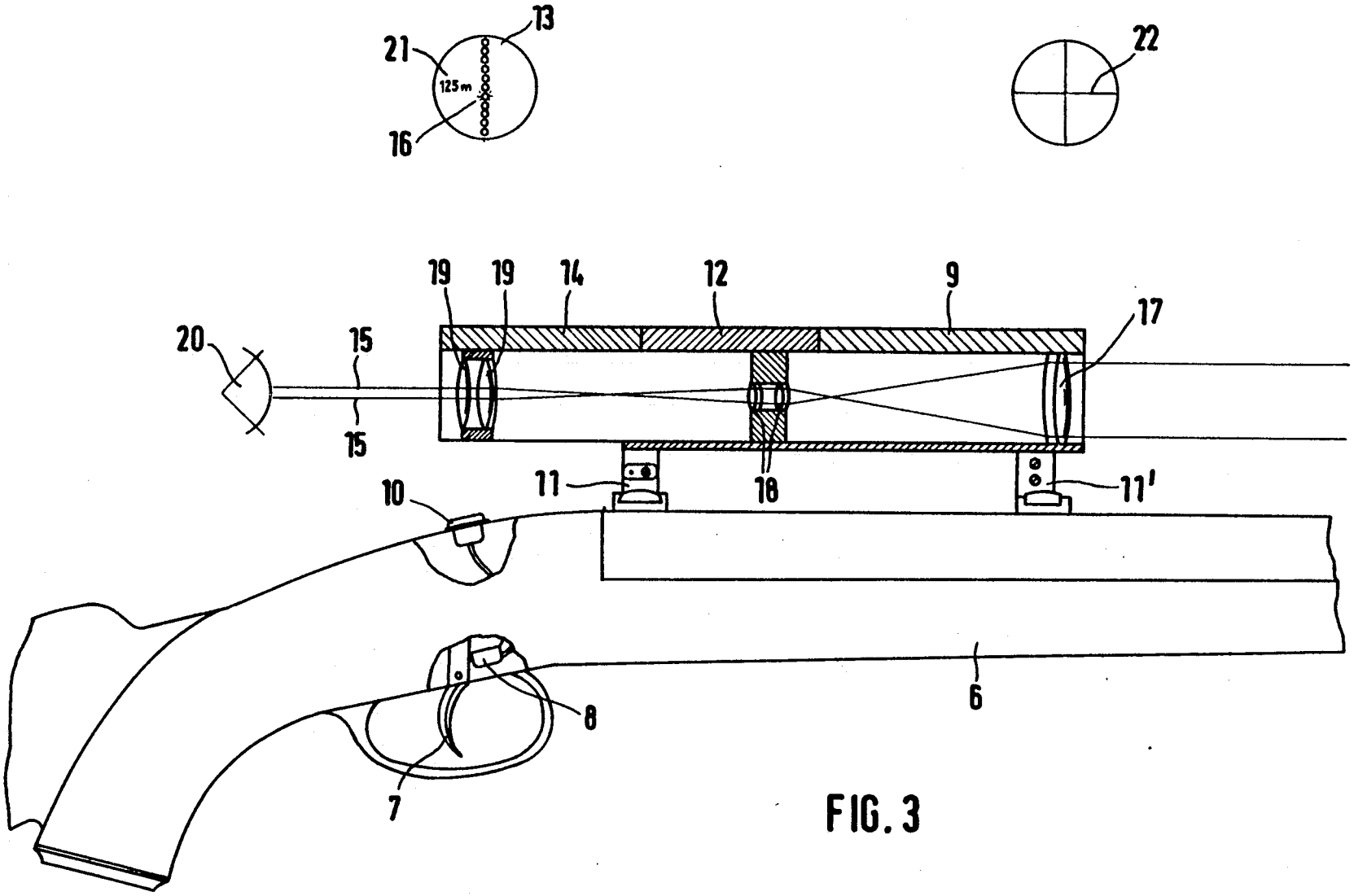
FIG. 3 is a view (in section) of a weapon fitted with an aiming device of the invention.

FIGS. 3 shows a weapon 6 fitted with the inventive aiming device. The power supply and wiring of the various units are not shown and are conventional. A switch 8 for range finding is so connected to trigger 7 that range finder 9 is switched on before the shot is fired. In parallel with the switch 8 is a second switch 10 which can be used to switch on the range finder 9 without any need to press the trigger 7. Assembly parts 11, 11' are so devised that the aiming device can be adjusted to the weapon 6; the parts 11, 11' also have insulated contacts for the wiring of the weapon and the aiming device. The range finder 9 has been shown diagrammatically as being in the aiming device but it can be received in the weapon 6. It is a conventional range finding system to detect distance. In particular, the pulse transmitted by the range finder 9, such as a laser beam or infrared beam or infrared beam or soundwaves or microwaves or the like, is reflected by the target and detected by the receiver in the range finder 9. The range is therefore calculated on the basis of the difference between the transit times. The range-finding data are then transmitted to the storage medium 12 which contains the predetermined known ballistic trajectory data for the weapon. The range-finding data are correlated with the stored ballistic trajectory data and a corresponding signal is produced.

The storage medium 12 is interchangeable so that the aiming device can be provided at choice with a wide range of ballistic data in a simple and economical manner. The signal output by the storage medium 12 actuates a vertical row 13 of diodes in unit 14, the same reflecting the row 13 into beam path 15 of the optical system. The diode 16 corresponding to the range and ballistic trajectory lights up.

The optical system of the aiming device is similar to that of an aiming telescope and comprises a lens 17, an inverting system 18 and an eyepiece 19. The beam path 15 is incident on the marksman's eye 20. According to another feature, the calculated range is reflected by the unit 14 as a value 21 into the beam path 15. As example in the drawings a calculated range of 125 m was chosen which is clearly apparent to the eye 20 as 125 m. As a simplified variant range jumps can be reflected in the form of symbols. As another simplified construction a maximum firing range can be set in the medium 12. The same then so actuates the diode row 13 that the corresponding diode 16 lights up permanently until the preset maximum range. Should the calculated range be greater, the diode 16 blinks.

In FIG. 3 cross-hairs 22 are schematically depicted disposed above the aiming device, but turned through 90° for illustrating how they appear to the eye 20. The crosshairs 22 are disposed in a first image plane and of course in the beam path 15. Also schematically shown above the aiming device and turned through 90° for illustration purposes is, in a second image plane, the reflected diode row 13 with the range value 21; the row 13 is shown as seen by the eye 20 upon the completion of range finding. With the range finder 9 switched off, the eye 20 sees only the cross-hairs 22. After the range finder 9 has been switched on the range value 21 lights up as an example and a corresponding diode 16 becomes visible. The other diodes of the row 13 are not visible. The lighting-up of the corresponding diode 16 is illustrated in the drawings as a ring of light beams.

Figure 4:
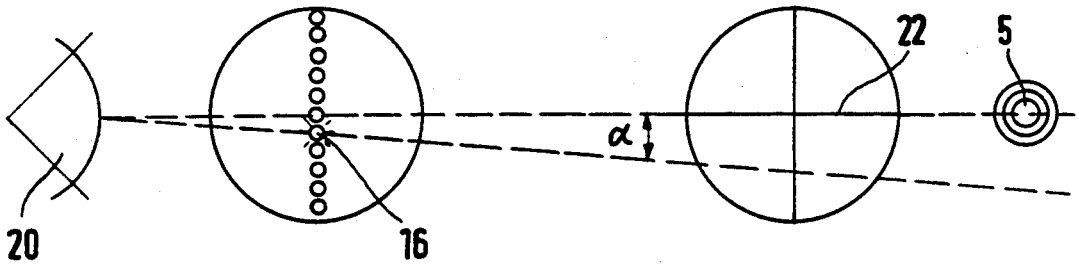
FIG. 4 is a diagrammatic view showing the marksman's eye, the aiming device and the target without point-of-aim correction.

FIG. 4 diagrammatically illustrates the inventive aiming device, the eye 20 and the target 5 without point-of-aim correction and also shows the arrangement for range-finding. Before a shot is fired the cross-hairs 22 and the target 5 are brought into registration with one another and the corresponding diode 16 lights up. The angle $\alpha$ is the correction angle.

Figure 5:
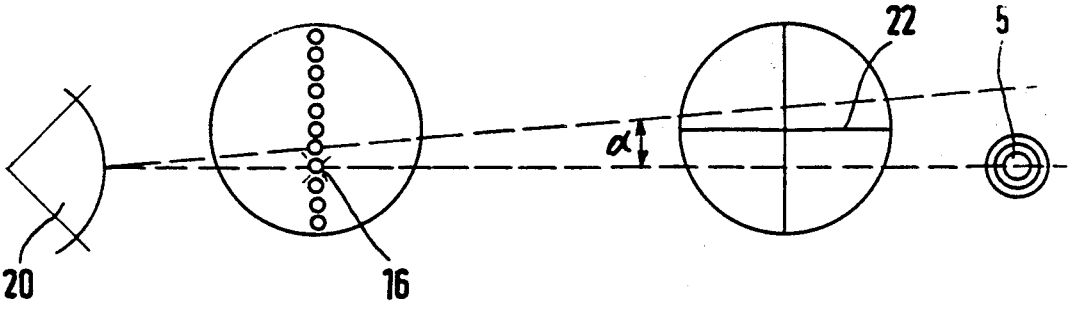
FIG. 5 is a diagrammatic view showing the marksman's eye, the aiming device and the target with point-of-aim correction.

FIG. 5 is another diagrammatic view of the aiming device, eye 20 and target 5 with point-of-aim correction, and it shows the arrangement immediately after the firing of the shot. The illuminated diode 6 and the target 5 are moved into registration with one another.

While the invention has been described in conjunction with certain embodiments, it is understood that various modifications and changes may be made with out departing from the spirit and scope of the invention.

What is claimed is:

1. A device to assist a person in aiming a weapon whose target can be disposed at changing distances and whose projectile follows a curved trajectory comprising:

(a) an optical system disposed on the weapon for the person to view the target along a beam path;

(b) range finder means for calculating the distance from the weapon to the target;

(c) interchangeable storage means communicating with the range finder means for correlating the distance calculated by the range finder means with ballistic trajectory data stored in the storage means to produce a corresponding signal; and (d) indicator means communicating with the storage means and having a plurality of indicators positioned at a predetermined location so as to be reflected into the beam path, and for one preselected indicator to be actuated by the signal such that the point of aim along the beam path and the point of impact of the projectile are brought into the registration with one another, wherein a predetermined maximum firing range is stored in the storage means, and wherein the preselected indicator lights up continuously in the case of calculated ranges up to the maximum range and blinks when the maximum range is exceeded.

2. A device according to claim 1, wherein data of a wide variety of precalculated ballistic trajectories for the weapon is written into the storage medium.

3. A device according to claim 1, wherein the indicators are a plurality of diodes.

4. A device according to claim 1, further comprising means for reflecting the range calculated by the range finder as a value into the beam path so as to become visible.

5. A device according to claim 1, further comprising means for reflecting the range calculated by the range finder as a symbol into the beam path so as to become visible.

6. A device according to claim 2, wherein the indicators are a plurality of diodes.

7. A device according to claim 6, further comprising means for reflecting the range calculated by the range finder as a value into the beam path so as to become visible.

8. A device according to claim 6, further comprising means for reflecting the range calculated by the range finder as a symbol into the beam path so as to become visible.

9. A method for using an aiming device to assist a person in aiming a weapon whose target can be disposed at changing distances and whose projectile follows a curved trajectory comprising:

(a) calculating the distance from the weapon to the target by a range finder;

(b) transferring the distance calculated to a storage means which stores predetermined ballistic trajectory data for the weapon;

(c) correlating the distance calculated by the range finder with the stored ballistic trajectory data so as to produce a corresponding signal;

(d) actuating one of a plurality of indicators located in the beam path of an optical system of the aiming device;

(e) aligning the actuated indicator with the target so as to bring the point of aim and point of impact of the trajectory into registration with one another, and (f) storing a predetermined maximum firing range in the storage means, wherein the actuating of one of a plurality of indicators located in the beam path includes lighting up the actuated indicator as a continuous light in the case of calculated ranges up to the maximum range and as a blinking light when the maximum range is exceeded.

10. A method according to claim 9, wherein the indicators are a plurality of diodes.

11. A method according to claim 9, further comprising reflecting the range calculated by the range finder as a value into the beam path so as to become visible.

12. A method according to claim 9, further comprising reflecting the range calculated by the range finder as a symbol into the beam path so as to become visible.

13. A method according to claim 10, further comprising reflecting the range calculated by the range finder as a value into the beam path so as to become visible.

14. A method according to claim 13, further comprising reflecting the range calculated by the range finder as a symbol into the beam path so as to become visible.

* * * * *